US006055745A

United States Patent [19]

Endoh

[11] Patent Number: 6,055,745

[45] Date of Patent: May 2, 2000

[54] SHOE AND METHOD OF MANUFACTURING SAME

[75] Inventor: Saburo Endoh, Tokyo, Japan

[73] Assignee: Valerian Shoes Co., Ltd., Japan

[21] Appl. No.: 09/317,164

[22] Filed: May 24, 1999

[30] Foreign Application Priority Data

Feb. 2, 1999 [JP] Japan ..... 11-025054

[51] Int. Cl.[7] ..... A43B 13/28; A43B 23/07; A43D 11/00

[52] U.S. Cl. ..... 36/12; 36/21; 36/55; 12/142 C; 12/142 T

[58] Field of Search ..... 36/12, 17 R, 19 R, 36/21, 17 A, 16, 18, 11, 10, 45, 43, 55; 12/142 C, 142 B, 142 D, 142 G, 142 T, 142 J

[56] References Cited

U.S. PATENT DOCUMENTS 284,066 8/1883 Rogers .

379,640 3/1888 French .

406,338 7/1889 Cross .

*Primary Examiner*—M. D. Patterson

*Attorney, Agent, or Firm*—Lorusso & Loud

[57] ABSTRACT

A shoe including a flexible shoe upper having areas adjacent cutouts at opposing sides thereof which include points corresponding to the metatarsal tibiale and fibulare of a human foot, which adjacent areas are secured by stitching to areas of a socklining adjacent cutouts on opposing sides thereof. The cutouts on the shoe upper, before being stitched, are longer than the cutouts of the socklining. The shoe may be prepared by stitching those cutout adjacent areas on opposing sides of the shoe upper to those cutout adjacent areas on opposing sides of the socklining, followed by adhesively bonding the remainder of the peripheral areas of the shoe upper and the socklining, and attachment of an outsole thereto.

6 Claims, 3 Drawing Sheets

SHOE AND METHOD OF MANUFACTURING SAME

BACKGROUND OF THE INVENTION

This invention relates to a shoe having a flexible or soft shoe upper secured to a socklining and to a method of manufacturing same.

Cementing is now widely used in manufacturing shoes. In the cementing process, an insole is temporarily fixed to a bottom of a last, which is then covered with a shoe upper. The shoe upper is then lasted manually or with a lasting machine to bring the shoe upper into a desired shape. The lasting margin is turned over and secured to the insole with a cement. An outsole is subsequently bonded to the insole with a cement. In this case, the shoe upper is strongly attracted to the last during lasting and, thus, is stretched. Therefore, when detached from the last, the shoe upper is unavoidably and spontaneously reduced in size from the desired shape determined by the last. As a result, the shoe thus obtained fails to effectively adapt to various foot shapes. Accordingly, portions of the foot near the metatarsal tibiale and fibulare are subjected to stresses.

A shoe upper bag-stitching method without using a last has been also adopted, in which a leather upper is fixed to an outsole by stitching. Shoes obtained by this method offer the advantage that the shoe upper has a soft feel. However, since a toe puff is not usable in perfect conditions, the shoe is deformed in use over several months. Further, this method has a drawback in that the appearance lacks sharpness and, therefore, the shoe upper bag-stitching method is seldom used for the fabrication of high fashion shoes.

SUMMARY OF THE INVENTION

Accordingly, it is an object of the present invention to provide a shoe in which the above-described problems of the conventional shoes have been solved.

Another object of the present invention is to provide a shoe having a flexible shoe upper which has resiliency or slack at the metatarsal tibiale and fibulare of the foot.

It is a further object of the present invention to provide a method for manufacture of such a shoe in an economically advantageous manner.

The present invention provides a shoe including a flexible shoe upper having areas adjacent and coextensive with cutouts on opposing sides thereof which respectively include points corresponding to the metatarsal tibiale of the human foot and which are secured by stitching to areas adjacent to and coextensive with cutouts on opposing sides of a socklining. The cutouts in the shoe upper are longer than the corresponding cutouts in the socklining so that the shoe upper is loose and expandable at regions surrounding the metatarsal tibiale and fibulare and, hence, no stresses to the foot occur in these regions. Further, since the most deformable portions of the shoe, namely portions corresponding to the metatarsal tibiale and fibulare of the foot, can smoothly adapt to the shape of the foot, no deformation of the shoe results from a long period of use.

The present invention also provides a method of manufacturing a shoe of a human foot, in which areas adjacent and coextensive with cutouts on opposing sides of a shoe upper, which areas include points corresponding to the metatarsal tibiale and metatarsal fibulare of the foot, are stitched to areas on opposing sides of a socklining adjacent cutouts having lengths shorter than the lengths of the cutouts of the shoe upper. The remaining peripheral areas of the shoe upper and the socklining are adhered together with an adhesive. An outsole is then attached to the bottom of the socklining.

BRIEF DESCRIPTION OF THE INVENTION

Other objects, features and advantages of the present invention will become apparent from the detailed description of the preferred embodiments of the invention which follows, when considered in light of the accompanying drawings, in which.

Figure 3A:
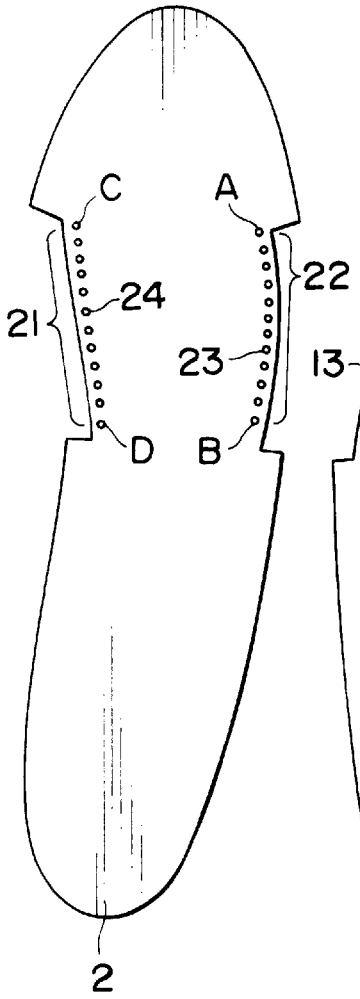
Figure 3B:
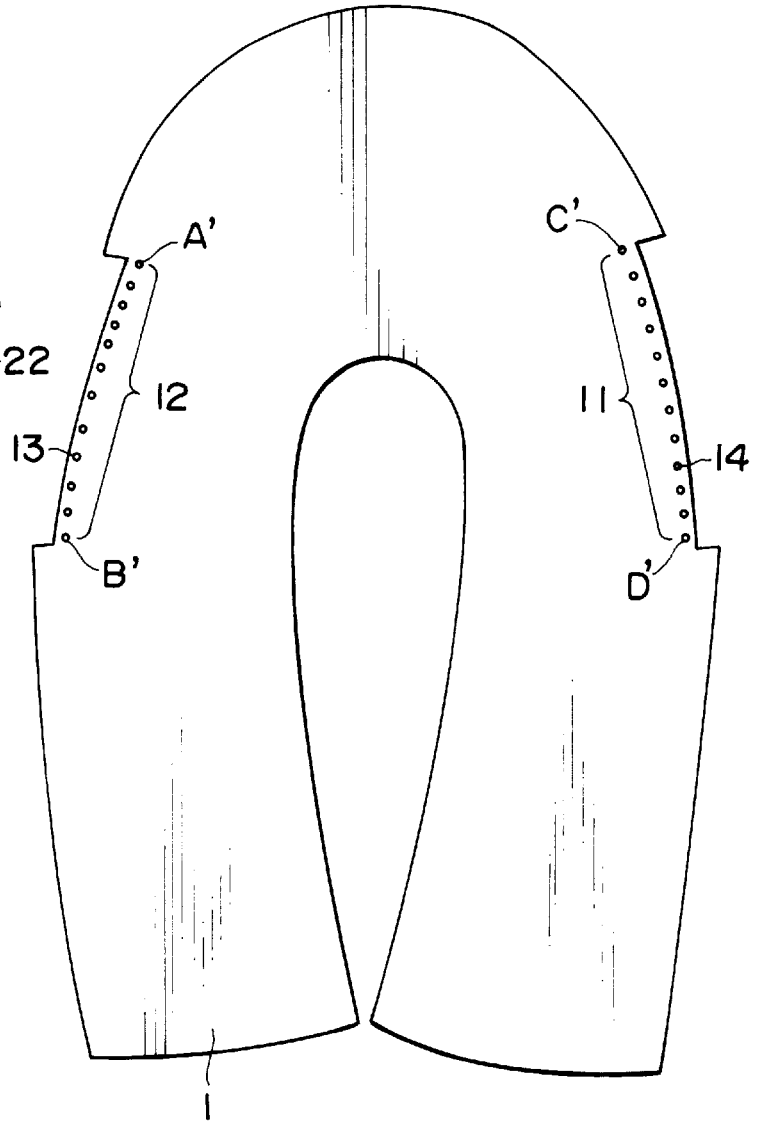
Figure 4:
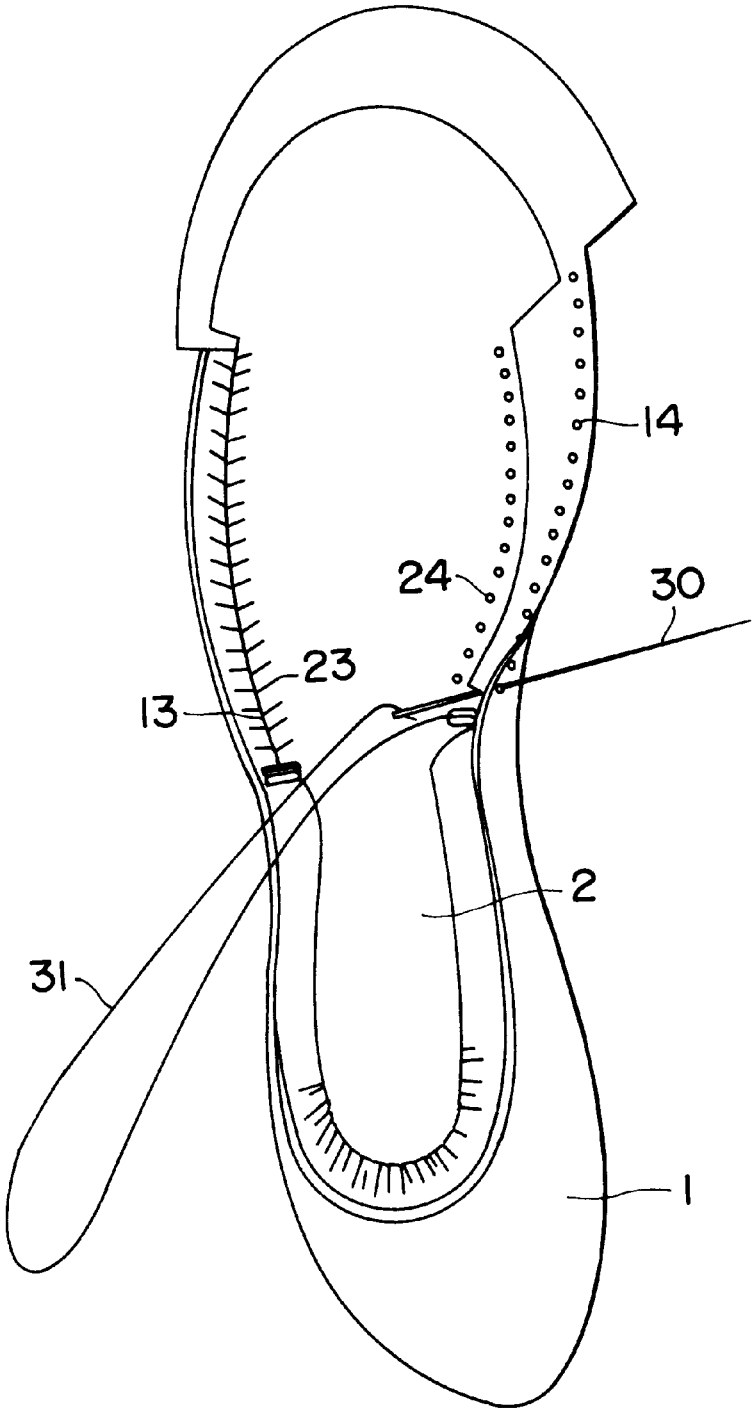

FIG. 3(*a*) and FIG. 3(*b*) are schematic illustrations of a socklining and a shoe upper, respectively, prior to stitching; and FIG. 4 is a schematic illustration of the socklining and the shoe upper during stitching.

DETAILED DESCRIPTION OF THE PREFERRED EMBODIMENTS OF THE INVENTION

Referring to FIGS. 1–4, reference numeral 1 denotes a shoe upper, 2 a socklining and 3 an outsole.

Areas adjacent to and coextensive with cutouts 11 and 12 on opposing sides of the flexible shoe upper 1 include a point P corresponding to the metatarsal tibiale of a foot and a point Q corresponding to the metatarsal fibulare of the foot, and are secured by stitching to areas adjacent to and extensive with cutouts 21 and 22 on opposing sides of the socklining 2.

The metatarsal tibiale is a portion near the end of the inner or preaxial metatarsal bone of a foot and is normally the most outwardly extended portion at the inner side of a foot. The metatarsal fibulare is a portion near the end of the outer or postaxial metatarsal bone of the foot and is normally the most outwardly extended portion at the outer side of the foot. The length of a line circumscribing the foot over the metatarsal tibiale and fibulare defines the foot circumference.

The lengths C'–D' and A'–B' (in FIG. 3(*b*)) of the cutouts 11 and 12 of the shoe upper 1, prior to connection to the socklining 2, are greater, respectively, than the lengths C–D and A–B (in FIGS. 3(*a*) and 3(*b*)) of the corresponding cutouts 21 and 22 of the socklining 2. Accordingly, the regions near the metatarsal tibiale and fibulare in the shoe upper 1, after stitching to the socklining 2, are sufficiently slack to adapt to the shape of the foot of a user and, hence, no deformation of the shoes occurs.

The length (C–D and A–B) of each of the areas 21 and 22 on opposing sides of the socklining 2 is suitably determined in accordance with the size and kind of the shoe. The length P–C is generally 1–5 cm, i.e. that portion extending from the metatarsal point to the toe, and the length P–D is generally 1–5 cm, i.e. that portion extending from the metatarsal point to the heel, with the total length C–D being 3–10 cm. The cutouts 11 and 12 of the shoe upper 1, prior to stitching, must be longer than the corresponding cutouts 21 and 22 of the socklining, respectively, and their lengths are each suitably determined according to the size and kind of the shoe, but generally the difference therebetween (between C–D and C'–D' and between A–B and A'–B') is 1–4 cm. A difference smaller than 1 cm fails to fully attain the effect of the present invention when the size of the shoe is large. Too great a difference, in excess of 4 cm, will cause wrinkle in the shoe upper 1 and adversely affect the appearance of the shoe when the size of the shoe is small.

The shoe upper 1 is made of any conventional soft shoe material, such as natural leather or synthetic leather. The socklining 2 is also made from a sheet of any conventional shoe material such as natural leather or synthetic leather. A trade name, etc. may be printed on or applied to the socklining 2. The term "socklining" used herein is intended to refer to a material provided on the top, foot-supporting surface inside the shoe. In this case, the "socklining" includes an insole and/or other suitable layers. For example, the socklining may be a three-layer structure in which a flexible sheet (e.g. a thin leather) is laminated to a cushioning layer (e.g. a sponge layer or a foam layer) and an insole (e.g. a thicker leather layer, a cork layer or a synthetic composite material layer containing a fibrous material), in this order.

The present invention may be applied not only to foldable shoes but also to any shoes having a flexible shoe upper such as various mens' or womens' leather shoes, e.g. long boots, sandals, high heel shoes, low heel shoes, pumps, formal shoes, sport shoes, business or school shoes and leisure shoes.

Next, a method of manufacturing a shoe according to the present invention will be described.

First, a socklining 2 as shown in FIG. 3(*a*) and a shoe upper 1 as shown in FIG. 3(*b*) are prepared. A plurality of generally equally spaced apart holes 24 are then formed in the areas adjacent cutout 21 of the socklining 2. The distance between two adjacent holes 24 is suitably in the range of 2–6 nm. Similarly, a plurality of generally equally spaced apart holes 23 are formed in the area adjacent cutout 22.

Likewise, a plurality of holes 14 and 13 are also formed adjacent cutouts 11 and 12, respectively, of the shoe upper 1. The distance between two adjacent holes 14 (and between two adjacent holes 13) is suitably in the range of 3–7 mm. The holes 14 (and 13) may be formed at equal distances. Preferably, however, the distance between two adjacent holes 14 (and 13) is gradually reduced from a point near the met atarsal tibiale (and fibulare) toward the both ends of the cutouts 11 (and 12).

In this case, as described previously, the length C–D of the medial-side 21 and the length A–B of the lateral-side 22 of the socklining 2 must be shorter than the length C'–D' of the medial-side cutout 11 and the length A'–B' of the lateral-side cutout 12 of the shoe upper 1. Therefore, the distance between to adjacent holes 24 of the socklining 2 is shorter than the distance between two adjacent corresponding holes 14 of the shoe upper 1, with the number of the holes 24 and 14 being the same. Similarly, the distance between two adjacent holes 23 of the socklining 2 is generally shorter than the distance between two adjacent corresponding holes 13 of the shoe upper 1, with the number of the holes 23 and 13 being the same.

Next, utilizing these holes 13, 14, 23 and 24, the shoe upper 1 is secured to the socklining 2 by stitching. More specifically, as shown in FIG. 4, using a needle 30 and a thread 31, stitching is manually performed hole to hole in order to tightly secure them. Of course, the stitching may be with a sewing machine. In the illustrated embodiment, the stitching is performed such that edges of socklining 2 are in abutting engagement with the edges of the shoe upper 1. If desired, however, the edges of the socklining 2 and the upper 1 may be overlapped.

After the areas adjacent cutouts 11 and 12 of the shoe upper 1 have been stitched to the areas adjacent cutouts 21 and 22 on opposing sides of the socklining 2, respectively, the assembly is mounted on a shoe last to conform the shape of the shoe upper 1 and the socklining 2 to the last. Then, the remaining peripheral marginal areas (other than the those adjacent cutouts 11 and 12) of the shoe upper 1 are turn over to the rear surface of the socklining 2 and the turned-over portions are bonded flush thereto with an adhesive.

Figure 1:
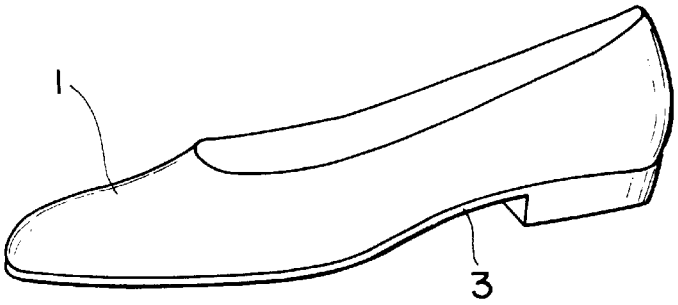
FIG. 1 is a perspective view of a portable and foldable female shoe according to one embodiment of the present invention.
Figure 2:
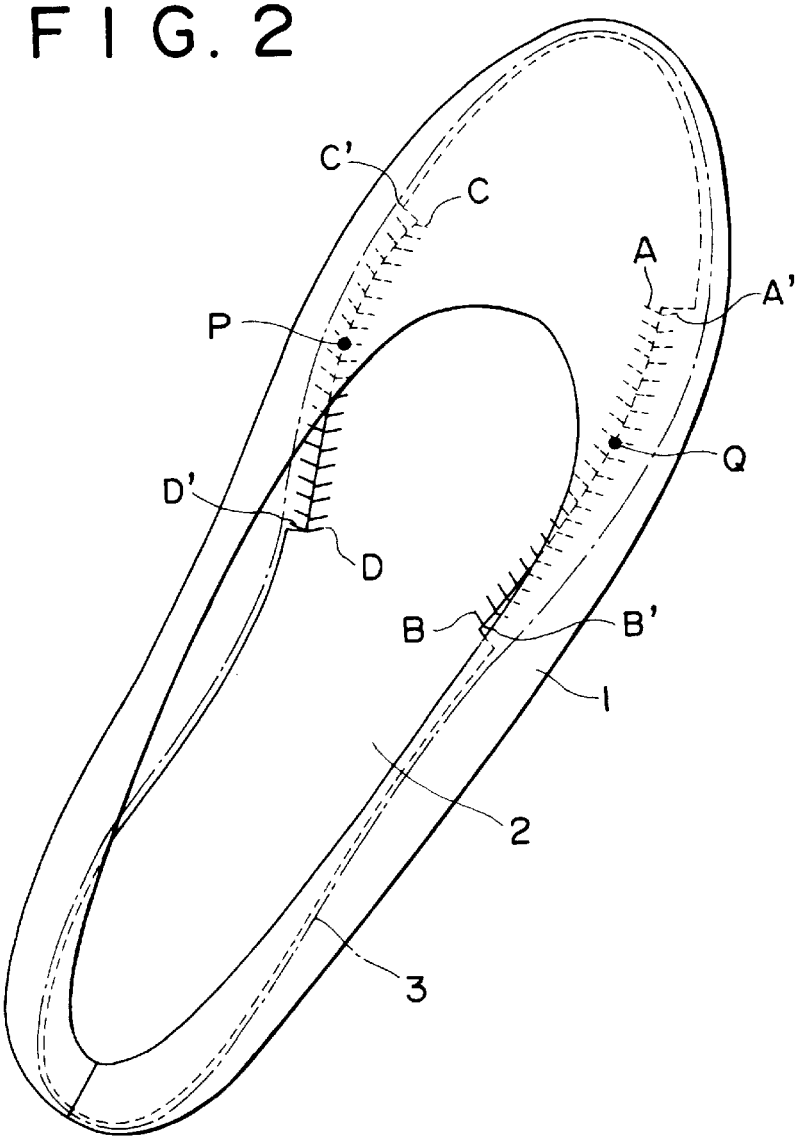
FIG. 2 is a plan view of the shoe of FIG. 1.

Thereafter, an outsole 3 is attached by any suitable method, such as manual stitching, Mckay process, Goodyear welt process, injection method and bonding method, so that the stitched portions or seems are not exposed outside the shoe. If necessary, before the attachment of the outsole 3, the backside (the surface to be bonded to the outsole 3) of the socklining 2 is ground, shaved and/or hammered to obtain a smooth surface. If desired, a counter, a toe insert, a shank, an insole, a heel insert, a heel and/or a cushioning material may be suitably inserted or attached in any conventional manner. Since the stitched portions or seems are exposed on the top surface of the socklining 2, as shown in FIG. 2, a thin sheet of a material such as of a leather may be applied on a forepart of the socklining 2 to hide the stitched seems, if desired.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all the changes which come within the meaning and range of equivalency of the claims are therefore intended to be embraced therein.

What is claimed is:

1. A shoe for a human foot having a metatarsal tibiale and a metatarsal fibulare, comprising a flexible shoe upper and a socklining each having cutouts on opposing sides thereof, said shoe upper having points P corresponding to the metatarsal tibiale and Q corresponding to the metatarsal fibulare in areas adjacent its cutouts, the areas of said shoe upper adjacent the cutouts being secured by stitching to areas of the socklining adjacent the socklining cutouts, wherein the cutouts of said shoe upper, before stitching, are longer than the cutouts of said socklining.

2. A shoe as claimed in claim 1, wherein peripheral portions of the shoe upper and the socklining, other than the stitched areas adjacent the cutouts, are adhesively bonded together.

3. A shoe as claimed in claim 2, further comprising an outsole attached to the bottom of the socklining.

4. A shoe as claimed in claim 1, wherein the socklining is a laminate comprising a top leather layer, an intermediate cushioning layer, and an insole layer, arranged in this order.

5. A method of manufacturing a shoe for a human foot having a metatarsal tibiale and a metatarsal fibulare, comprising:

stitching areas adjacent cutouts on opposing sides of a shoe upper, including a point P corresponding to the metatarsal tibiale and a point Q corresponding to the metatarsal fibulare, to areas adjacent cutouts on opposing sides of a socklining, the lengths of the cutouts in the opposing sides of the socklining being shorter than the lengths of cutouts of the shoe upper;

adhesively bonding peripheral portions of the shoe upper and the socklining, other than the stitched areas adjacent the cutouts; and bonding an outsole to the socklining.

6. A method as claimed in claim 5, further comprising, before said stitching, forming a plurality of holes in areas adjacent the socklining cutouts and in areas adjacent the shoe upper cutouts, wherein said stitching is connecting the holes in the socklining to the corresponding holes in the shoe upper with threads.

* * * * *